United States Patent [19]

Watson

[11] 4,316,350

[45] Feb. 23, 1982

[54] WING SCREW EARTH ANCHOR

[76] Inventor: Gary Q. Watson, 311 River Rd., Del Rio, Tex. 78840

[21] Appl. No.: 97,424

[22] Filed: Nov. 26, 1979

[51] Int. Cl.[3] ..... E02D 5/80

[52] U.S. Cl. ..... 52/157

[58] Field of Search ..... 52/157

[56] References Cited

U.S. PATENT DOCUMENTS

| | | | |
|---|---|---|---|
| 3,148,510 | 9/1964 | Sullivan | 52/157 X |
| 3,645,055 | 2/1972 | Roza | 52/157 |
| 3,736,711 | 6/1973 | Thornbrugh | 52/157 X |

FOREIGN PATENT DOCUMENTS

| | | | |
|---|---|---|---|
| 686340 | 5/1964 | Canada | 52/157 |

*Primary Examiner*—Price C. Faw, Jr.
*Assistant Examiner*—Carl D. Friedman
*Attorney, Agent, or Firm*—Gunn, Lee & Jackson

[57] ABSTRACT

A wing screw earth anchor formed by a metal casting adapted to be rotatably embedded in the ground by a powered device generally referred to as a digging machine. The particular design of the earth anchor of this invention has a central body projecting to a point. Opposite the point is a drive nut which receives the shaft of a digging machine for screwably embedding the anchor in the earth. Between the point and the drive nut is a cylindrical anchor cylinder from which projects an anchoring spiral. The spiral projects outward from the point in a 90° arc from zero to four inches, which is the maximum radius of the anchoring spiral. In the subsequent, central segment, which extends from 180°, the radius is constant at four inches. The final segment of the anchoring signal is a trailing taper which extends from 120° terminating in a trailing point. A threaded section inside the drive nut receives threadably a one-inch diameter anchor rod to which may be secured a guy wire or rod which is desired to be anchored securely to the ground. The anchoring spiral projects on a plane of approximately 5° upward from the point to the spiral termination at its trailing tip. The diameter of the preferred embodiment was eight inches and the anchoring spiral has a lift of approximately four inches in 360°.

5 Claims, 5 Drawing Figures

WING SCREW EARTH ANCHOR

BACKGROUND OF THE INVENTION

1. Field of the Invention

This invention pertains to an earth anchor which is screwably embedded into the ground with a power rotating machine generally referred to as a digging machine. The variations in this invention from the prior art reside primarily in the configuration of the anchoring spiral formed from cast iron or other metals having a thick outer edge projecting upward from a point, spiralling from a zero radius to a maximum radius terminating in a trailing taper and trailing point. The configuration of the earth anchor of this invention is such that as the anchor is power driven into the ground by rotation with a digging machine, the anchor, upon contacting stones, force them to the outer circumference as the anchor proceeds to be screwed into the ground. An improved embedding and retention characteristic of the anchor is achieved.

2. Description of Prior Art

Numerous configurations of earth anchors have been developed and patented. These anchors generally comprise auger or screw-type configurations very similar to a propeller. Among the related, previously patented devises are patents such as the one to Black, U.S. Pat. Nos. 2,395,033, which employs two semi-circular members mounted on a shaft in the configuration of a circular propeller. Brown, 2,643,843, which pertains to a sand anchoring device has a pointed shaft with two tilted blades projecting outward in a propeller-like fashion. Perhaps the closest related patent is Sullivan, 3,148,510, which is an earth anchor screwably driven into the ground in a manner very similar to the concept of this invention. The configuration of the Sullivan anchor is essentially a helical, one-turn earth auger. The configuration of the anchoring spiral or wing of the screw earth anchor of this invention differs in its configuration and improved operation and stability when screwed into the ground. The configuration of the anchor of this invention affords an improved and different result when rotatably embedded into the earth.

SUMMARY OF THE INVENTION

The wing screw earth anchor of this invention is designed to be embedded into the ground with a digging machine similar to that shown and described in Sullivan, U.S. Pat. No. 3,148,510. Any wide variety of hydraulic, cable, or gear driven powered rotating digging devices can be employed with proper mechanical adaptation for embedding the earth anchor of this invention in the ground. When the earth anchor of this invention is screwably embedded into the ground, normally a threaded, one-inch anchor rod is attached to the anchor rod threads in the center of the drive nut of the upper extremity of the central body of the device of this invention. The configuration of the earth anchor of this invention is constructed around a central body portion projecting from the drive nut on one end to the point projecting into the ground. The configuration of the device is such that the drive nut and drive shoulder will receive the power shaft of a digging machine. The center of the drive nut includes anchor rod threads to which is secured an anchor rod as the device is being embedded into the ground. The configuration of the device of this invention, progressing upward from the point, comprises an anchoring spiral approximately one-half inch thick. This spiral originating at a zero radius from the point, and in the first 90° of the arc extends to a four-inch radius. The central segment of the anchoring spiral continues for 180° at the four-inch radius. Afterward, the trailing taper continues for 120° terminating in a trailing point. The configuration of the device is such that the diameter of the central segment is approximately eight inches. The slope of the anchoring spiral is approximately 5° with the anchoring spiral resulting in a lift of approximately four inches in 360°. In the preferred embodiment, the drive nut was one and three-sixteenths by one and three-sixteenths inches, approximately two inches in length terminating in a drive shoulder. The anchor cylinder was approximately four inches long at a diameter of approximately two inches terminating in the point from which the anchoring spiral begins and proceeds upward. The characteristic of the device of this invention is that when the wing screw earth anchor is forcibly rotated and driven into the ground, stones or rocks contacting the leading edge are forced outward, compacting the dirt at the circumference of the anchoring spiral. The improvement of this invention resides principally in its configuration and characteristic not having a leading cutting edge, which cuts and loosens and disrupts the soil, but a progressive sprial compacting the soil outward carrying with it rocks and pebbles which are contacted. The characteristic of the trailing taper terminating in a trailing point tends to leave the soil in a more stable, uninterrupted position than the cutting edge earth augers heretofore utilized.

BRIEF DESCRIPTION OF THE DRAWINGS

For a detailed illustration of the device of this invention, attention is invited to the attached several views wherein identical reference characters will be employed to refer to identical or equivalent components throughout the various views and the following detailed description.

FIG. 2 gives a good illustration of the drive nut and the drive shoulder.

DESCRIPTION OF THE PREFERRED EMBODIMENT

Figure 1:
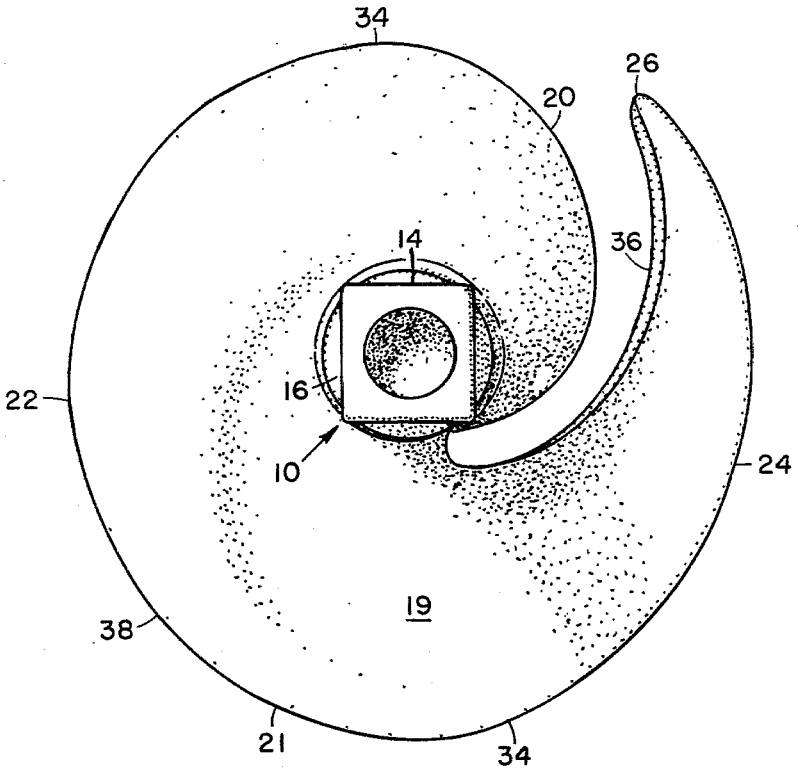
FIG. 1 is a top view of the wing screw earth anchor of this invention illustrating the relative position of the drive nut, the projection of the anchoring spiral, and the general configuration of the point segment, central segment, and the trailing taper terminating in a trailing point.
Figure 2:
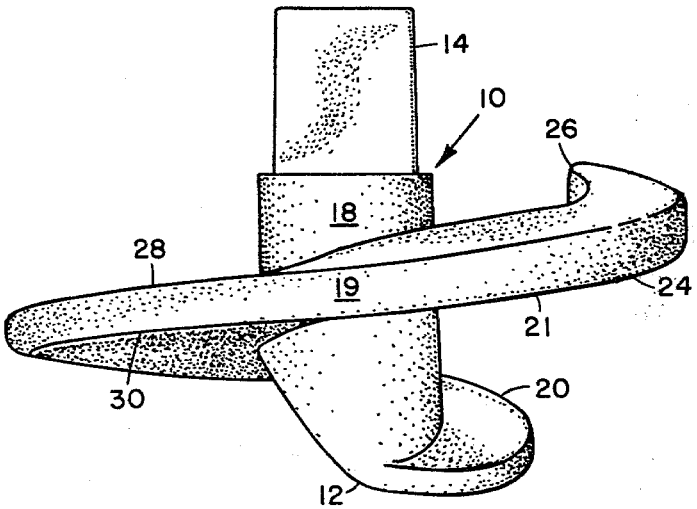
FIG. 2 is a side view of the device of this invention illustrating principally the scope and configuration of the anchoring spiral as it projects from the point spiraling around the anchor cylinder projecting upward to the trailing point.
Figure 3:
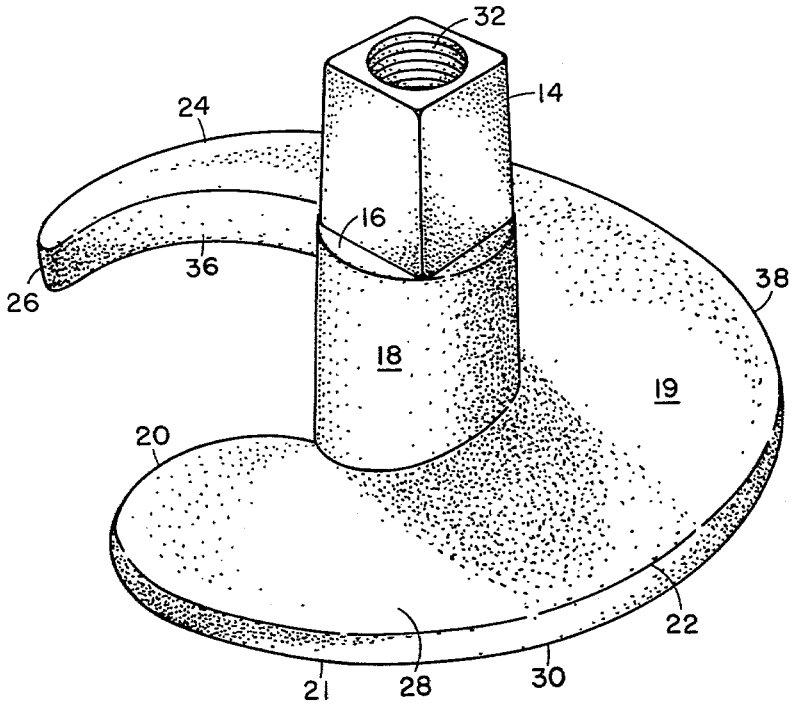
FIG. 3 is a side perspective view viewed slightly from above further illustrating the general configuration of the device of this invention and particularly the anchor rod threads to which are secured the anchor rod.
Figure 4:
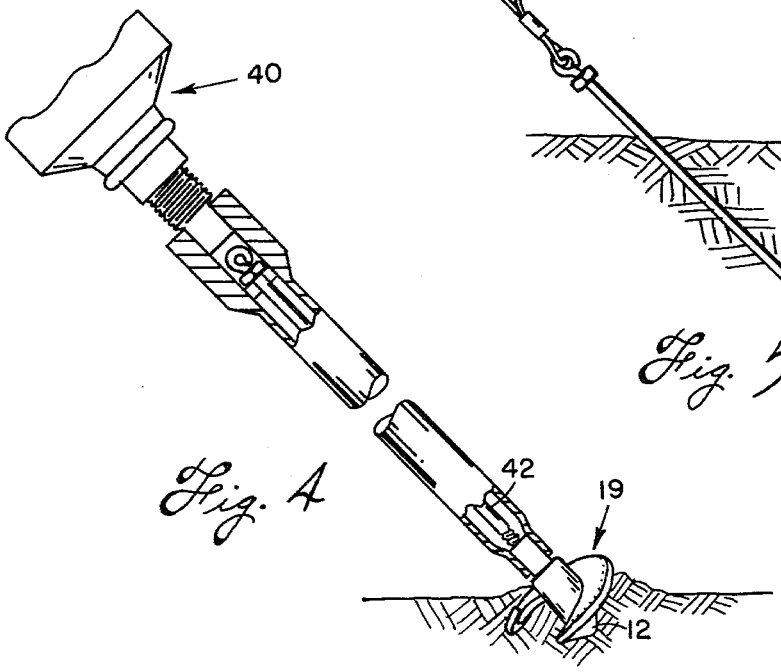
FIG. 4 is a side schematic view illustrating how the anchor of this device may be embedded in the ground with a digging machine.
Figure 5:
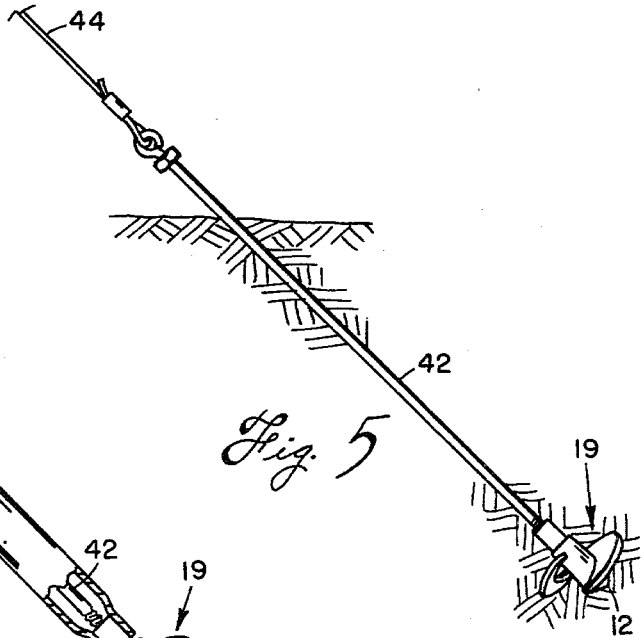
FIG. 5 is a schematic illustration of a wing spiral earth anchor embedded into the ground attached to an anchor rod to which is secured a guy wire.

For an illustration of the construction and utilization of the preferred embodiment, attention is particularly invited to FIGS. 1 and 2. The preferred embodiment was of cast iron construction having a configuration as illustrated in the drawings. Other metals might be utilized and dimensions of the anchor might be greater or lesser, depending on the use for which it is intended. The device of this invention is constructed around a central body 10 which projects to a point 12. At the upper extremity of the central body 10 is formed a one and three-sixteenths by one and three-sixteenths inch drive nut 14 terminating in an abutting drive shoulder 16 which may receive and engage the drive shaft of the digging machine 40 partially illustrated in FIG. 4. A digging machine of the type generally described in U.S. Pat. No. to Sullivan, 3,143,510, is satisfactory for embedding the anchor of this invention. Proceeding downward in the central body 10 below the drive shoulder 16 is approximately a four-inch anchor cylinder 18 around which winds the anchoring spiral 19. The configuration of this anchoring spiral 19 is wherein resides the improvement comprising the wing screw earth anchor of this invention. The anchoring spiral 19 progresses around and upward along anchor cylinder 18 at a slope of approximately 5°. In the design and construction of the anchor of this invention, perhaps as best illustrated in FIG. 2, the lift on the anchoring spiral is approximately four inches in 360°. The configuration of the outer edge of the anchoring spiral 19 is designed with a view to giving an improved embedding and anchoring result. The first 90° of the anchoring spiral 19 comprises the point segment 20. The outer edge 21, extending through this 90° point segment, projects from a zero radius at the point 12 to a radius of four inches as the anchor spiral 19 projects around this first segment of anchor cylinder 18. The next segment of the anchoring spiral 19 is the central segment 22 which continues for 180° around the anchor cylinder 18 with the outer edge 21 maintaining a constant radius of four inches. Projecting upward after the central segment 22 is an elongated, trailing taper 24 which, while continuing the four-inch radius for a span of 120°, tapers from the inside out to a trailing point 26. The foregoing configuration of the wing screw earth anchor, the configuration of the outer edge 21 in combination with the slope of the anchoring spiral 19 contributes substantially to the improved results of this invention. Anchoring spiral 19 has an upper surface 28 and a lower surface 30. The specific thickness of the anchoring spiral is not believed to be critical to this invention; however, in the preferred embodiment, the distance between the upper surface 28 and the lower surface 30 was of a somewhat tapered configuration having a thickness of something less than one-half inch adjacent the point 12 and terminating in a thickness of approximately three-fourths inch at the trailing point 26. This configuration was found to be satisfactory. The gradually increasing thickness during the projection of the trailing taper 24, though desirable from an overall strength standpoint, perhaps also facilitates an improved projection of the anchor into the earth as it is rotatably driven into the anchoring soil. Formed into the center drive nut 14 are anchor rod threads 32 which may threadably engage an anchor rod 42 as illustrated in FIG. 5. The anchor threads 32 are best suggested in FIG. 3. In the ultimate utilization of the device of this invention, anchor rod 42 engages anchor rod threads 32 and guy wire 44 may be securely attached to anchor rod 42. A factor in the configuration and construction of this invention pertains to an increased spiral circumference 38 which tests have indicated relate directly to the holding power of an earth anchor. A circular disk embedded in the ground having a diameter of eight inches is believed to have less holding power than the device of this invention having a diameter of eight inches primarily because of the increased spiral circumference 38 which in essence is the length of the outer edge 21 combined with the length of the interior point to cylinder arc 36, which is the interior edge of the anchoring spiral proceeding from trailing point 26 inward to the anchor cylinder 18.

OPERATION OF THE DEVICE

As previously stated, the device of this invention may be screwed or embedded into the ground with equipment generally referred to as a digging machine 40. One type of these machines is described and illustrated in U.S. Pat. No. to Sullivan, 3,148,510. Any rotating type power machine similar to a tractor mounted device for drilling post holes or the larger devices utilized for emplanting poles for power lines or telephone lines are adaptable for embedding the wing screw earth anchor of this invention in the ground. The device of this invention was developed for just such utilization. This type earth anchor is quite suitable for embedding into the ground as illustrated in FIG. 4 and utilized as illustrated in FIG. 5 to retain guy wires 44 for anchoring communication lines, power lines, oil rigs, towers, or any structure requiring an anchored stabilization to the earth. The particular configuration of the anchoring spiral 19 of this invention gives an improved result both while embedding the anchor and in utilization of the anchor after embedding. The gradually flaring tapered outer edge 21 upon contacting a stone embedded in the soil does not abruptly contact the stone with a cutting leading edge stalling the device or some other undesirable results, but the embedded stones are forced by the gradually spiralling outer edge 21 to the outer circumference 38 as the screw earth anchor progresses into the ground. Slopes, angles, and configurations of this earth anchor gives an improved result.

The device of this invention has been illustrated in several views and its construction defined in detail. What is desired to be claimed is all modifications and embodiments of this structure not departing from the scope of equivalents of the invention as defined in the appended claims.

I claim:

1. A cast wing screw earth anchor comprising:

a. a central body terminating in a point;

b. an anchoring spiral encircling said central body, said spiral constructed with:

c. a point segment spiralling from said point of said central body to the maximum radius of said anchoring spiral within an arc of 90°;

d. a flared spiral central segment extending for 180° from said point segment to;

e. an elongated trailing taper extending from said flared spiral 120° to;

f. a trailing point, said anchoring spiral having a substantially squared blunt outer edge and an upper and lower surface, the distance between said upper and lower surface at said trailing point being approximately $\frac{3}{4}''$ tapering to $\frac{1}{2}''$ at said point, said anchoring spiral additionally projecting upward from said point at substantially a constant spiralling slope of not less than 4° nor more than 7°.

2. The invention of claim 1 wherein said anchoring spiral lifts 4″ in 360°.

3. The invention of claim 1 wherein said outer edge of said anchoring spiral projects from a zero radius at said point to a radius of 4" at said central segment, continues for 180° around said central body maintaining a constant radius of 4", further continuing around said central body for a span of 120° at a radius of 4" to terminate by tapering from the inside out to said trailing point.

4. The invention of claim 1 further comprising a drive nut capable of engaging a rotating shaft for embedding said wing screw anchor into the earth.

5. The invention of claim 1 further comprising:

a. anchor rod threads constructed in the central body capable of threadably receiving, b. an achor rod.

* * * * *